United States Patent [19]

Stevens

[11] 4,099,578

[45] Jul. 11, 1978

[54] HINGED BULLDOZER BLADE

[76] Inventor: John L. Stevens, P.O. Box 374, Eureka, Mont. 59917

[21] Appl. No.: 767,440

[22] Filed: Feb. 10, 1977

[51] Int. Cl.[2] ..... E02F 3/76

[52] U.S. Cl. ..... 172/802

[58] Field of Search ..... 172/801, 802, 806, 786, 172/781; 37/50, 29, 34, 35

[56] References Cited

U.S. PATENT DOCUMENTS

| | | | |
|---|---|---|---|
| 829,418 | 8/1906 | McNair | 37/35 |
| 2,230,704 | 2/1941 | Sorensen | 172/802 |
| 3,512,589 | 5/1970 | Ulrich | 172/786 |
| 3,693,724 | 9/1972 | Fueslein | 172/456 |

FOREIGN PATENT DOCUMENTS

| | | | |
|---|---|---|---|
| 231,393 | 4/1969 | U.S.S.R. | 172/802 |
| 236,344 | 12/1969 | U.S.S.R. | 172/802 |
| 371,316 | 7/1973 | U.S.S.R. | 172/802 |

*Primary Examiner*—Richard J. Johnson
*Attorney, Agent, or Firm*—Wells, St. John & Roberts

[57] ABSTRACT

A hinged bulldozer blade with a central blade body and hinged outward ends coupled with a mechanism for selectively pivoting the hinged ends such that the blade can be arranged in any of several configurations. By selectively pivoting the sections independently of one another, the blade may be made to scoop and push material forwardly, remove material to either side of the blade structure, or remove material to both sides of the blade. A lockout mechanism is provided between the pivoted blade sections and the blade body that effectively transmits forces supplied to the blade sections directly to the blade body rather than through the attached jack assemblies by which the sections are pivoted. The blade body and end sections include complementary hinge surfaces that prevent formation of gaps between the hinged blade sections and the central blade body regardless of the pivoted position of the sections.

5 Claims, 9 Drawing Figures

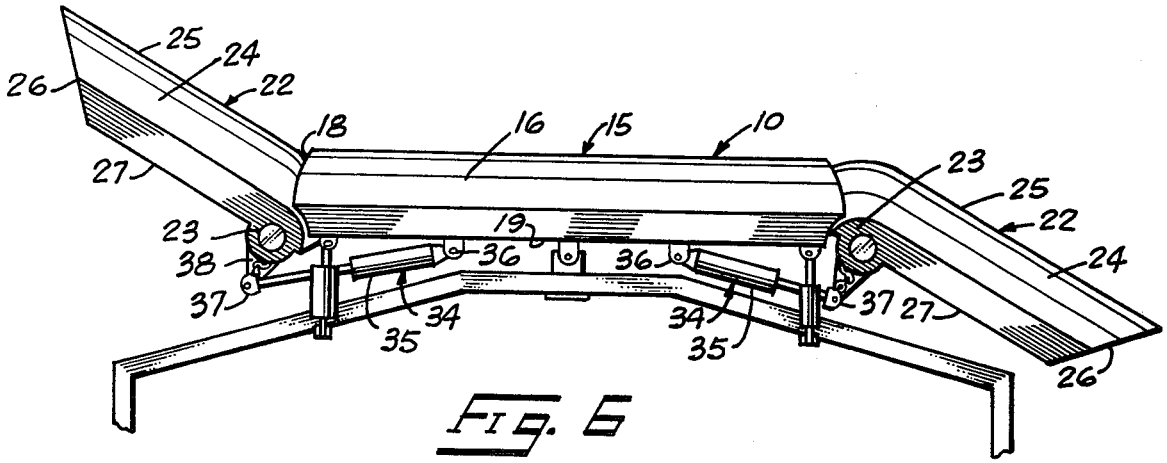
FIG. 6
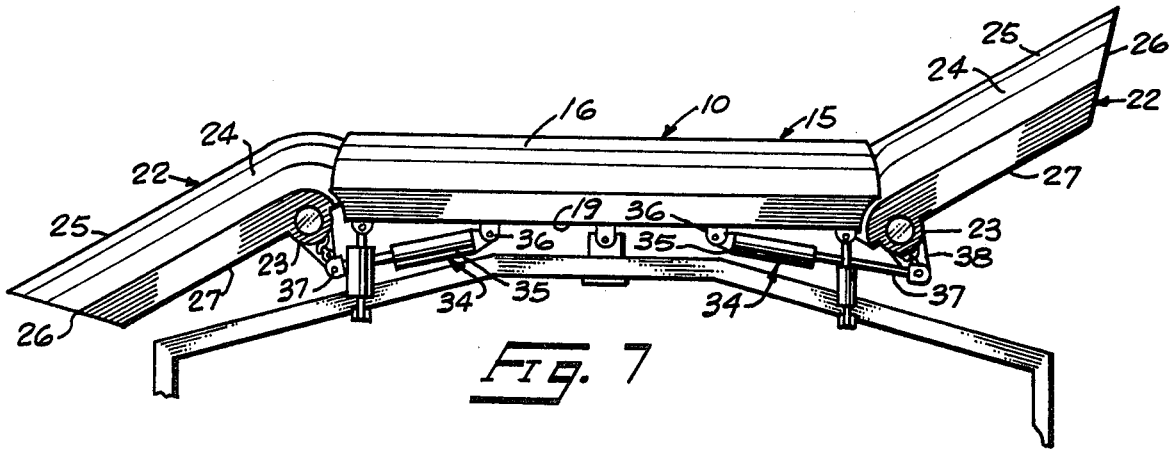
FIG. 7
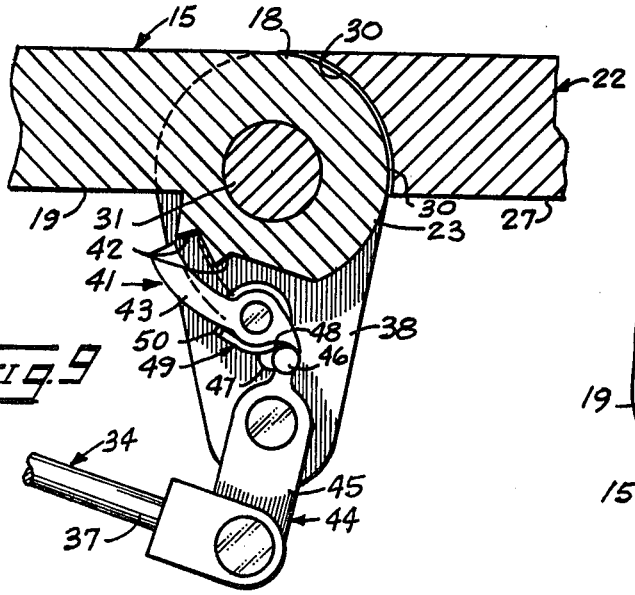
FIG. 9
FIG. 8
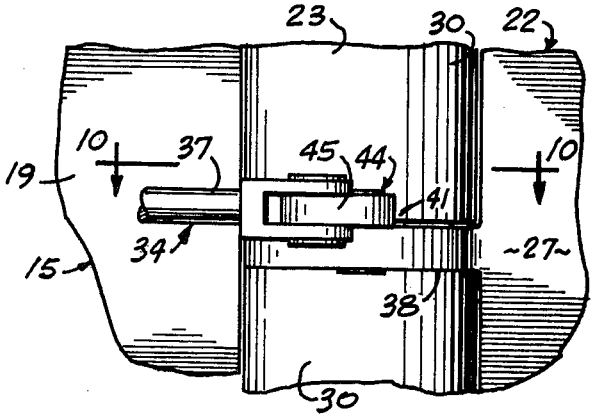

HINGED BULLDOZER BLADE

BACKGROUND OF THE INVENTION

The present invention relates basically to the field of bulldozer blades and more particularly to such blades that are adjustable or hinged in order to adapt the blades to different working requirements.

It is generally always difficult and extremely time consuming to remove and replace bulldozer blades, particularly since they are much too heavy for manual handling. The blades must be changed when the bulldozer is to be used for purposes other than that for which the present blade was designed. Separate blades must be used for pushing material forward of the bulldozer, dividing material, or scraping material to one side or another. It is time consuming to change blades and expensive to keep a ready supply of different blades on hand. As a result, work is often scheduled in an inefficient manner and it is not unusual that the operator will be required to utilize a single blade for all the functions described above. This results in inefficient use of the bulldozer and consequently increases the cost of operation.

It is obviously desirable to obtain some form of bulldozer blade that is adjustable to enable the blade to function efficiently in performing several separate operations that would ordinarily require differing types of blades. The present invention was designed with that thought in mind. As will be understood from the following description, I have invented an adjustable, hinged bulldozer blade that can be selectively adjusted to facilitate efficient operation of the blade to perform all the functions described above.

My blade is designed to be easily adapted to conventional blade mounting arrangements and further includes integral jack assemblies that may be connected to the bulldozer's hydraulic fluid supply to enable selective adjustment of the blade without requiring additional attachments to the bulldozer. The blade is comprised of an elongated central body section and includes opposed outward blade sections hinged to the opposite ends of the body. The sections may be pivoted about vertical axes independently of one another to facilitate positioning of the blade sections in any of several combined configurations. Thus, without leaving the operator's seat, the bulldozer operator may quickly change the blade configuration to accomplish different purposes in a matter of seconds. No device is known to the applicant that accomplishes this function.

SUMMARY OF THE INVENTION

A selectively adjustable bulldozer blade is described that includes a central blade body that is adapted for mounting to a bulldozer. The central blade body has two blade sections pivotably mounted at the ends thereof. The blade sections and blade body have a forward concave face for engaging and moving material as the bulldozer is moved in a forward direction. The blade sections are mounted to the blade body at opposite ends thereof for pivotal movement about parallel upright axes. The blade sections and blade body include complementary hinge members that serve to interconnect the sections and body to effectively prevent formation of a gap between the sections and body when the sections are pivoted relative to the body. Jack means is provided that is selectively operable to pivot the blade sections independently of one another to selected angular positions relative to the angular disposition of the blade body.

It is a first object of the present invention to provide a bulldozer blade that is selectively adjustable to enable any of several different functions to be performed by the blade without necessitating removal of the blade and replacement with a blade specifically designed for the intended function.

Another object is to provide such an adjustable blade that is extremely sturdy in construction and capable of performing equally as well as other integral, one piece blades that are specifically designed for the varying functions.

A still further object is to provide such an adjustable bulldozer blade that is substantially self-contained and may be operated by the conventional hydraulic system of the bulldozer to which the blade is mounted.

An additional object is to provide such an adjustable bulldozer blade that includes a mechanism by which the blade sections may be selectively locked in position relative to the blade body to therefore transfer forces to the blade body and associated framework rather than to the mechanism for pivoting the blades during adjustment operations.

A yet further object is to provide such a blade that, regardless of the pivoted angular positions of the blade sections, will not present any substantial gap between the pivoted sections and blade body which would ordinarily become easily compacted with the material being operated upon.

A yet further object is to provide such a blade that is extremely simple in construction and is relatively maintenance free.

These and still further objects and advantages will become apparent upon reading the following description which, taken with the accompanying drawings, discloses a preferred form of my invention. However, the following description is not intended to place restrictions upon the scope of my invention. It is provided to merely disclose a preferred form of my invention and it is presently understood that various other forms may be contemplated that may yet fall within the breadth of my invention. Therefore, only the claims to be found at the end of this specification are to be taken as strict definitions of what I consider to be my invention.

BRIEF DESCRIPTION OF THE DRAWINGS

FIG. 6 is a view similar to FIG. 2 only showing a different arrangement of the blade body and end sections;

FIG. 7 is a view similar to FIG. 6 only showing another different arrangement of the blade body and end sections;

FIG. 8 is an enlarged fragmentary view of a portion of the hinge area of my blade; and FIG. 9 is a sectional view taken along line 9—9 in FIG. 8.

DETAILED DESCRIPTION OF A PREFERRED EMBODIMENT

Figure 1:
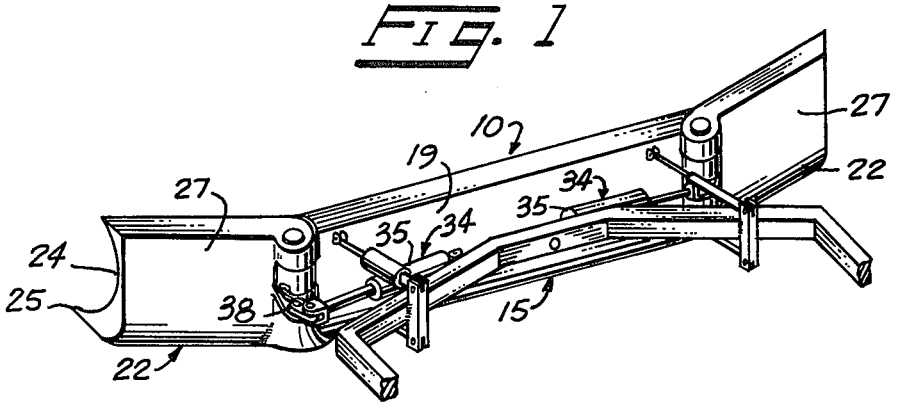
FIG. 1 is a pictorial view of my blade arrangement.

The present invention is illustrated in the accompanying drawings and is generally designated therein by the reference character 10. The present blade 10 is adapted to be mounted to a bulldozer 11 through a conventional mounting bracket 12. It should be noted that the bracket 12 as shown is only one of several conventional forms of mounting brackets and that the present blade structure may be adapted for mounting to substantially any form of conventional blade mounting bracket. Often, different blade mounting brackets provide pivotal control functions that enable the blade to be tilted about a horizontal transverse axis or to be angularly relative to the forward path of the bulldozer. The structure of the present blade will not interfere with the functions of the conventional brackets but may eliminate the necessity of providing such brackets since the conventional adjustments are often provided in an attempt to adapt a form of conventional blade to perform other functions.

The blade 10 includes a central blade body 15. Blade body 15 is somewhat similar in configuration to conventional straight single piece blades. It includes a concave face 16 with a lower forwardly projecting cutting edge 17. Edge 17 may be provided with removable wear plates that may be replaced after wear from extensive use. The blade body 15 includes opposed ends 18 and a substantially planar back surface 19.

Two blade end sections 22 are pivotably mounted to the blade body 15. They are mounted to the blade body through the provision of complementary hinge members 23 on sections 22 and body 15. Each blade section also includes a concave face 24. The concave faces 24 match exactly with the concave face 16. When the sections and body are in alignment, the concave faces are continuous across the full length of the blade. Sections 22 also include lower forwardly projecting cutting edges 25. These edges may also be provided with removable wear plates as described for the blade body 15. Each blade end section 22 further includes a beveled outside end 26. These ends are beveled for the purpose as shown in FIGS. 1, 2, 6 and 7 so the leading edges of the beveled ends are the furthest outwardly projecting portions of the blade regardless of the positions selected for the blade sections 22.

The blade end sections 22 and blade body 15 are interconnected through provision of the complementary hinge members 23. These members are comprised of interfitting upright hinge surfaces 30 in the form of paired concave and convex end surfaces that are generated about the pivot axes for the blade sections. The surfaces 30 are arranged such that they are generated about radii from the hinge axes that are tangential to the concave faces 24 and 16 (FIG. 9). Each pair of concave and convex end surfaces has substantially common radial dimensions relative to the upright hinge axis between them. Thus, regardless of the angular position of the blade end sections relative to the blade body, a uniform narrow gap is maintained between the sections and body. This gap may be so narrow that materials will not bind between the blade sections and body.

The hinge members 23 are interconnected by upright pins 31. The pins 31 are held within aligned apertures in the body and end sections 21 and 22 respectively and define the pivot axes of the blade sections. These axes are substantially vertical and parallel with one another. It is noted that the axes are located toward the back surface 19 of body 15 and similar back surfaces 27 of the blade sections 22. The blade thickness ahead of the pivot axes strengthens the blade at otherwise weak areas.

The blade end sections 22 are selectively pivoted about the axes of pins 31 through provision of a jack means 34. It is noted that jack means 34 is provided as an integral part of the blade 10. The jack means is adapted to be connected to conventional hydraulic power supplies of the associated bulldozer. Therefore, jack means 34 may be operated from the operator's seat of the bulldozer to selectively pivot the blade end sections into selected positions, several of which are shown in the drawings.

The jack means 34 is comprised of a pair of hydraulic cylinders 35. Cylinders 35 are mounted at brackets 36 to the blade central body 15. They include piston ends 37 that are connected to rearwardly projecting ears 38 of the blade sections 22. Extension and retraction of the cylinders 35 will cause corresponding pivotal movement of the blade sections 22 relative to the central blade body 15. Retraction of the cylinders 35 will result in rearward pivotal movement of the blade sections, and extension of the cylinders will conversely cause the blade sections to pivot forwardly.

I have provided a lockout means 41 in order to eliminate the need for extremely high capacity cylinders 35. The lockout means 41 (FIG. 9) is provided at both ends of the blade body 15. Each means 41 includes a number of catch surfaces 42 that are formed integrally in the blade ends 18. Three catch surfaces 42 are shown at each end of the blade body. However, it is understood that more or fewer catch surfaces may be provided according to the intended use of the blade. Catch surfaces 42 are designed to be engaged by pivoted lugs 43. These lugs 43 are pivotably mounted to the ears 38 of sections 22.

A lost motion actuator means 44 is provided that interconnects the ears 38 with the cylinders 35. Means 44 is comprised of links 45 that are pivotably mounted to the ears 38. They include inner actuator pins 46 that are movably received within arcuate slots 47 in the ears 38. The slots 47 allow restricted pivotal movement of the links 45 in response to operation of the cylinders 35. Pins 46 operatively engage rearwardly projecting cam surfaces 48 of the lugs 43. The cam surfaces 48 project into the path of the pins 46 to be engaged by the pins when the cylinders 35 are retracted. The resulting condition is shown in FIG. 9. Normally, the lugs 43 are biased toward engagement with the catch surfaces 42 by a biasing means 49 in the form of torsion springs 50. (The closed operative position of a lug 43 is shown by dashed lines in FIG. 9.)

When the lockout means 41 is operative, that is, when the lugs 43 are engaged with any of the catch surfaces 42, forces applied to the associated blade sections will be transmitted through the lugs to the central blade body. The cylinders 35 are not required to withstand the considerable forces applied to the pivoted sections in order to hold them in position. The lockout means 41 eliminates this function and provides that the only required duty of the cylinders 35 is to selectively adjust the sections to desired angular positions relative to the dispostion of the blade body.

The lost motion actuator means 44 is automatically operable to disengage the lockout means 41 to allow pivotal movement of the blade end sections in a rearward direction. It does this pivoting the lugs 43 away from engagement with the catch surfaces 42 to thereby allow pivotal movement of the sections. The force exerted by the cylinders 35 may then act against the blade sections to pivot them rearwardly. When it is desired to pivot the blade sections forwardly, the cylinders are extended. The force applied by the cylinders is applied through the pivoted links 45 directly to the ears 38. The lugs 43 may pivot freely as they move over the catch surfaces 42 while the sections are pivoted forwardly. The lugs pivot in opposition to biasing means 47 so they will automatically click into engagement with the catch surfaces as the blade end sections pivot forwardly.

Figure 2:
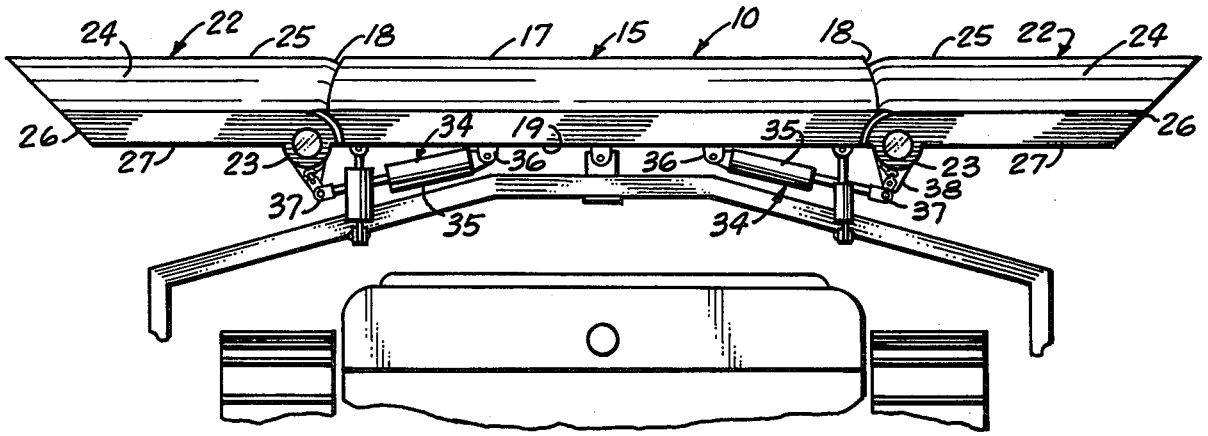
FIG. 2 is an enlarged top plan view.
Figure 3:
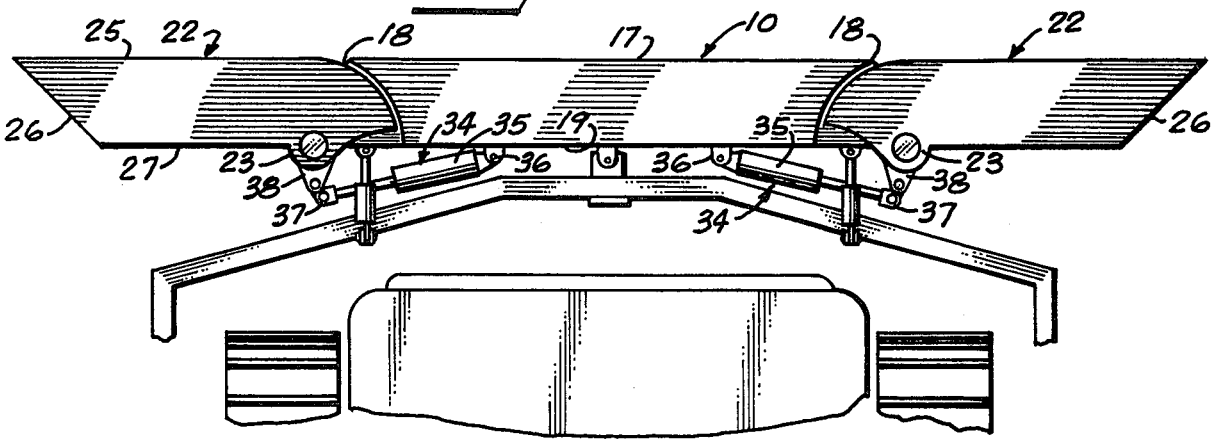
FIG. 3 is a bottom plan view.
Figure 4:
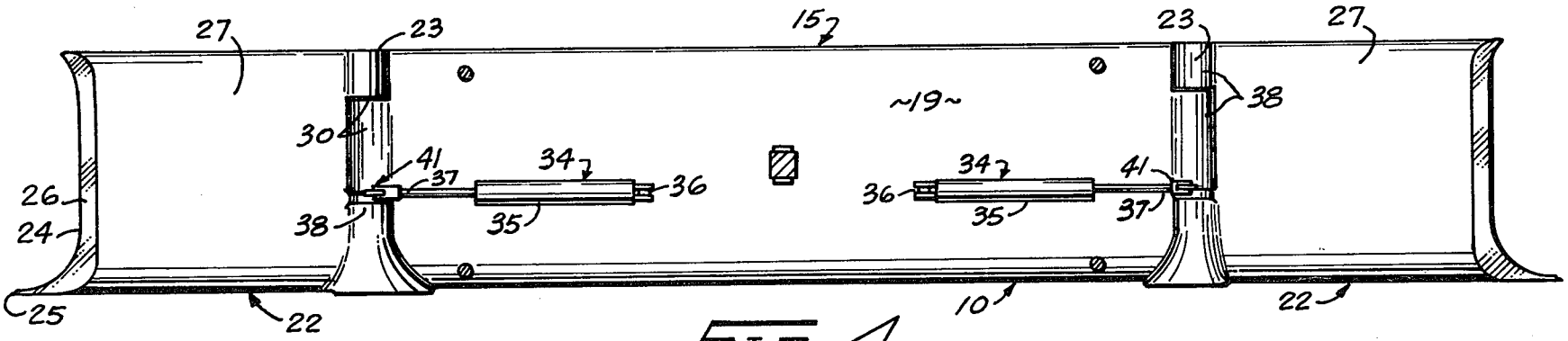
FIG. 4 is an enlarged rear elevational view.
Figure 5:
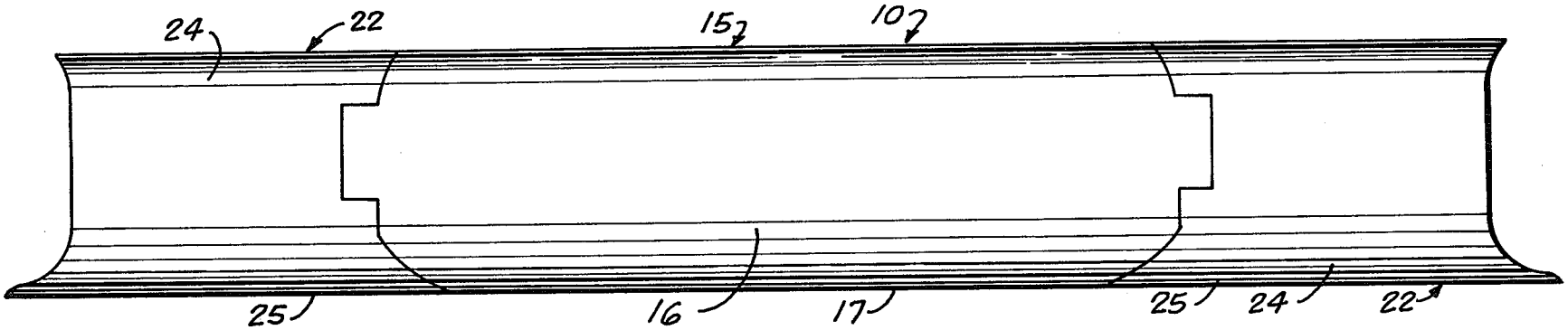
FIG. 5 is a frontal elevational view.

In operation, once the blade 10 has been mounted appropriately to the associated bulldozer through bracket 12, there should seldom be any occurrence that would require its removal since the blade is fully capable of performing functions that previously required different forms of bulldozer blades. The blade may be adjusted to accommodate forward pushing of material by pivoting both blade sections forwardly relative to the blade body (FIG. 1). If material is to be collected and distributed to either side of the bulldozer, the blade may be appropriately adjusted by locating one section forwardly of the body and by positioning the remaining section rearwardly of the body (FIGS. 6 and 7). Material will therefore be directed across the length of the blade and depostied on the side of the bulldozer adjacent the rearwardly projecting blade section. Further, if the operator wishes to clear a path by moving material to both sides of the bulldozer, he may pivot both sections 22 to the rearward positions. The engaged material will drift to both sides of the blade rather than build up to be carried forward of the blade. The blade may also be straightened as shown in FIGS. 2 and 3.

It is again noted that the drawings and above description present merely a preferred form of the invention and that minor modifications thereof will not depart from the scope of the invention. The following claims are given to provide a precise definition and to set the restrictions upon what I claim to be my invention.

What I claim is:

1. A selectively adjustable bulldozer blade, comprising:

a central blade body adapted for mounting to a bulldozer and having a forward concave face;

blade end sections mounted to the blade body at opposite ends thereof for pivotal movement thereon about parallel upright axes;

said blade sections having forward concave faces matching the concave curvature of the body face;

complementary hinge members interconnecting the sections with the body ends to prevent formation of a gap between the sections and body when the sections are pivoted relative to the body;

jack means selectively operable to pivot the blade sections independently of one another to selected angular positions relative to the angular dispostion of the blade body;

lockout means interconnected between the jack means and blade end sections and blade body for selectively fixing the blade end sections in prescribed angular positions and releasing the blade end sections for pivotal movement upon operation of the jack means;

said lockout means being comprised of:

successive catch surfaces on the blade body ends;

a pivoted lug on each blade section selectively engageable with the catch surfaces;

a lost motion actuator means on each blade end section operatively connected to the jack means and engageable with the pivoted lug for selectively disengaging the pivoted lug from the catch surfaces to allow pivotal movement of the blade end sections in response to operation of the jack means.

2. The blade as set out by claim 1 wherein the lost motion actuator means is supplemented by biasing means for normally urging the pivoted lugs toward engagement with the catch surfaces.

3. A selectively adjustable earth moving blade for a bulldozer or like vehicle, comprising:

a first blade section adapted for mounting to a vehicle, said first blade section having a forwardly facing concave surface along vertical planes across the width thereof;

a second blade section having a forwardly facing concave surface across the width thereof matching the concave surface of the first blade section;

upright hinge means joining one end of said first blade section to one end of said second blade section for relative pivotal motion with respect to one another about an upright hinge axis;

said upright hinge means including interfitting complementary paired concave and convex end surfaces integral with said first and second blade sections;

each end surface being tangential to the concave surface of the blade section on which it is formed and each pair of concave and convex end surfaces having substantially common radial dimensions relative to the upright hinge axis, whereby a uniform narrow gap is maintained between the blade sections while permitting relative pivotal movement of one blade section relative to the other about the upright hinge axis.

4. The blade as set out in claim 3 wherein the first and second blade sections each include substantially planar back surfaces that are coplanar to one another when the first and second blade sections are in alignment;

the upright hinge axis between said first and second blade sections being in close proximity to the back surfaces thereof.

5. The blade as set out in claim 3 further comprising:

powered means operatively connected between said first blade section and said second blade section for angularly positioning one blade section relative to the other about said upright hinge axis.

* * * * *